United States Patent [19]

Friedrichs et al.

[11] Patent Number: 4,871,202

[45] Date of Patent: Oct. 3, 1989

[54] LOCK FOR DOORS OR THE LIKE

[75] Inventors: Bernd Friedrichs, Arolsen; Willi Hankel, Waldeck, both of Fed. Rep. of Germany

[73] Assignee: HEWI Heinrich Wilke GmbH, Arolsen, Fed. Rep. of Germany

[21] Appl. No.: 97,646

[22] Filed: Sep. 16, 1987

[30] Foreign Application Priority Data

Sep. 17, 1986 [DE] Fed. Rep. of Germany ..... 3631516

[51] Int. Cl.[4] ..... E05C 1/16

[52] U.S. Cl. ..... 292/169

[58] Field of Search ..... 292/167, 169, 173, 143, 292/188, 166

[56] References Cited

U.S. PATENT DOCUMENTS

| | | | |
|---|---|---|---|
| 1,786,521 | 12/1930 | Dermody | 292/173 X |
| 2,769,330 | 11/1956 | O'Connell | 292/173 X |
| 3,141,693 | 7/1964 | Fugit | 292/173 |
| 3,201,161 | 8/1965 | Castle | 292/173 |
| 3,909,052 | 9/1975 | James | 292/169 |

FOREIGN PATENT DOCUMENTS

| | | | |
|---|---|---|---|
| 8425060 | 12/1984 | Fed. Rep. of Germany . | |
| 516589 | 4/1921 | France . | |
| 801348 | 8/1936 | France . | |
| 31605 | 12/1933 | Netherlands | 292/245 |
| 416362 | 1/1967 | Switzerland . | |
| 233920 | 5/1925 | United Kingdom . | |
| 595618 | 12/1947 | United Kingdom . | |
| 2053338 | 2/1981 | United Kingdom . | |
| 2115055 | 9/1983 | United Kingdom . | |
| 2137688 | 10/1984 | United Kingdom . | |

*Primary Examiner*—Richard E. Moore

[57] ABSTRACT

A lock for doors or the like with a case (8) having a longitudinal axis (9), a locking member (16) mounted in the case to be slidable parallel to the longitudinal axis, a bush (29) mounted in the case to be rotatable about an axis of rotation arranged at right angles to the longitudinal axis, and a drive having driving parts (35, 37, 21, 23) on the locking member and on the bush for converting rotary movements of the bush into sliding movements of the locking member, the locking member being slidable by rotation of the bush at least out of a locking position into a retracted open position. So that the driving parts and the bush can be made sufficiently stable even with a small over-all height or a small total cross-section of the lock, the driving parts are arranged both in the locking position and in the open position of the locking member (16) in a space in the lock case (8) located between the closing member (16) and the bush (29).

15 Claims, 14 Drawing Sheets

Fig.24.
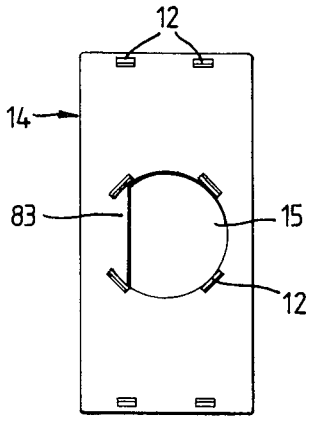
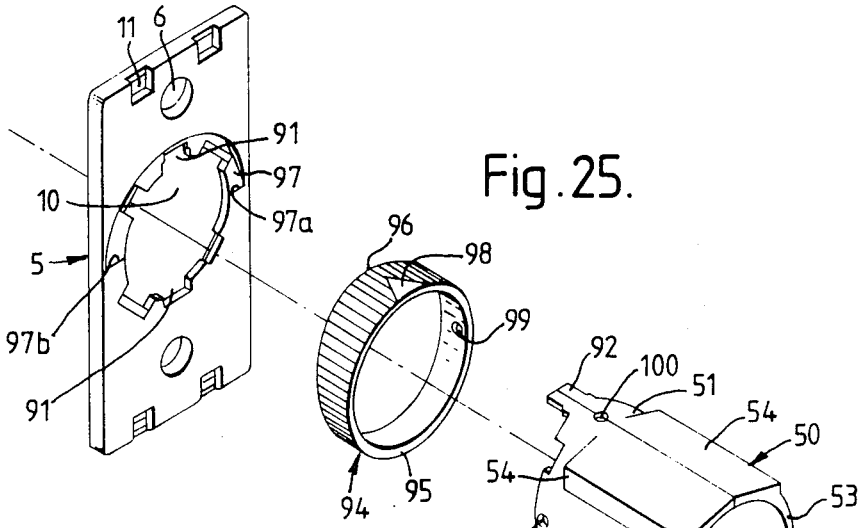
Fig.25.
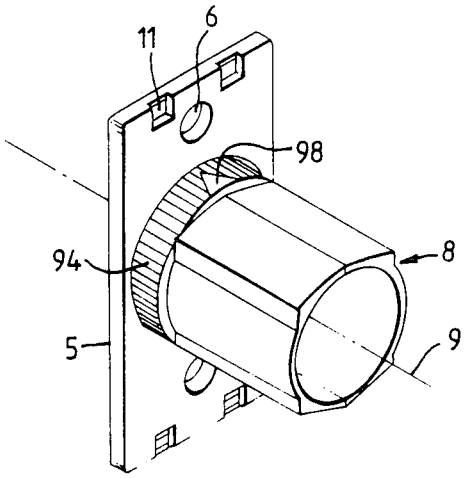
Fig.26.

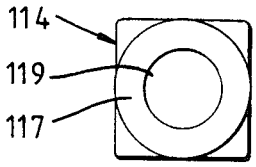
Fig. 34
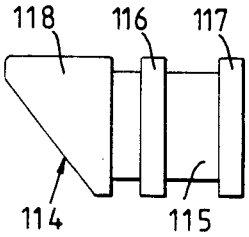
Fig. 35
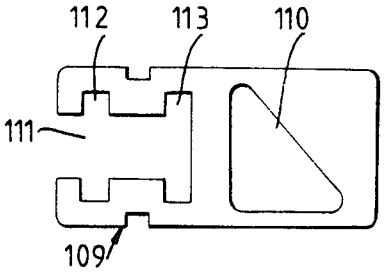
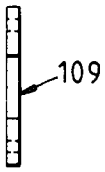
Fig. 36 Fig. 37

LOCK FOR DOORS OR THE LIKE

The invention relates to a lock for doors or the like with a case having a longitudinal axis, a locking member mounted in the case to be slidable parallel to the longitudinal axis, a bush mounted in the case to be rotatable about an axis of rotation arranged at right angles to the longitudinal axis, and a drive having driving parts on the locking member and on the bush for converting rotary movements of the bush into sliding movements of the locking member, the locking member being slidable by rotation of the bush at least out of a locking position into a retracted open position.

Locks of this type are known in many different versions and are employed as pure latch or bolt locks, but also as combination latch and bolt locks. In known locks (German Utility Model No. 75 25 386), for converting the rotary movement of the bush into a linear movement of the particular locking member, a plate coupled to the latter and slidable in its axial direction is provided which has driving parts in the form of offset projections engaged from behind by driving parts on the bush in the form of radially projecting arms. Depending upon the direction of rotation of the bush, one of the two arms draws the plate and, consequently, the locking member back in opposition to the force of a spring. In a similar form of construction which has already been used, radial lugs on the bush engage behind two pins which connect to one another two extensions on the locking member which are slidably mounted at the axial ends of the bush. Finally, it is also known to connect the driving parts on the locking member and on the bush to one another by a toothed-wheel gear (German Utility Model No. 76 17 533) or a crank gear (German Utility Model No. 76 37 271, German Utility Model No. 81 32 207). All the said locks are moreover provided with driving parts and/or supplementary operating elements which partially embrace the bush or at least must be guided between the top and/or bottom lock case wall and the outer periphery of the bush when the latch is drawn back and thereby affect the over-all height of the lock.

The known locks do not present any problems as long as their all-round dimensions can be chosen comparatively large. On the other hand, if the height dimension of the local or the diameter of an essentially cylindrical lock housing must not exceed a comparatively small value of e.g. 25.4 mm (one inch), as is laid down in some countries by standardization, then this results in corresponding limitations in the dimensioning of the bush, the locking member, the driving parts and the operating elements which are present in addition if need be. This applies all the more as the likewise standardized cross-section of the spindle projecting through the bush and connected to handles cannot be reduced.

In consequence of these limitations and the design of the known locks; the driving parts and the wall portions surrounding the central bore of the bush can be made only comparatively thin. As a result, with the action of too strong a force on the spindle projecting through the bush, permanent distortions of the various components may easily come about which, for example, lead to an undesirable skew state of the handles in their normal position. It is also possible that, by reason of the inadequate stability, some driving part or the bush will crack or break, in particular when handles in the form of door push means having large lever arms are provided, with which considerable torques can be transmitted.

An object underlying the invention is to construct the lock of the kind indicated at the beginning so that the driving parts and the bush can be made sufficiently stable even with a small over-all height or small total cross-section of the lock.

A further object of the invention is to design the lock such that with a small angle of rotation of the bush a large stroke of the locking member can be attained, even with small lock dimensions or lock cross-sections.

A further object of the invention is to design the lock such that different distances between the bush axis and the faceplate can be provided with simple means.

A further object of the invention is to design the lock such that it is optionally suitable for application in doors or the like hingeing on the right and on the left and also in doors or the like having an oblique extending rebate.

The invention is characterized in that the driving parts are arranged both in the locking position and in the open position of the locking member in a space in the lock case located between the locking member and the bush. The drive preferably is a combined lever and wedge drive. In a particular preferred embodiment of the invention, the locking member is rotatably mounted in the lock case, and the lock is provided with an arrangement by means of which the faceplate can be swivelled.

The invention brings with it the advantage that the lock does not have any driving parts which are constantly arranged or arranged at least during the actuation of the latch in a space between the bush and the top and/or bottom housing wall of the lock. In this way, the height of the lock is independent of the dimensions of the drive, so that the driving parts and also the bush can be made very stable. In particular, the bush can be provided with a wall thickness corresponding practically to the distance between the top and bottom housing wall or the over-all height of the lock. Distortion of the lock or other destructive effects are thereby largely avoided.

The invention is described in detail hereinafter with reference to embodiments in connection with the accompanying drawings, in which:

FIG. 24 is a rear view of a covering cap of the lock which is shown in section in FIG. 2;

FIG. 25 shows in exploded view an arrangement of the lock according to FIG. 2 for swivelling its faceplate;

FIG. 26 is a perspective view of the arrangement according to FIG. 25 in the assembled state;

FIGS. 34 and 35 are a side view and a front view of the locking member of the lock according to FIG. 31;

FIGS. 36 and 37 are a front view and a side view of a slide of the lock according to FIG. 31.

Figure 1:
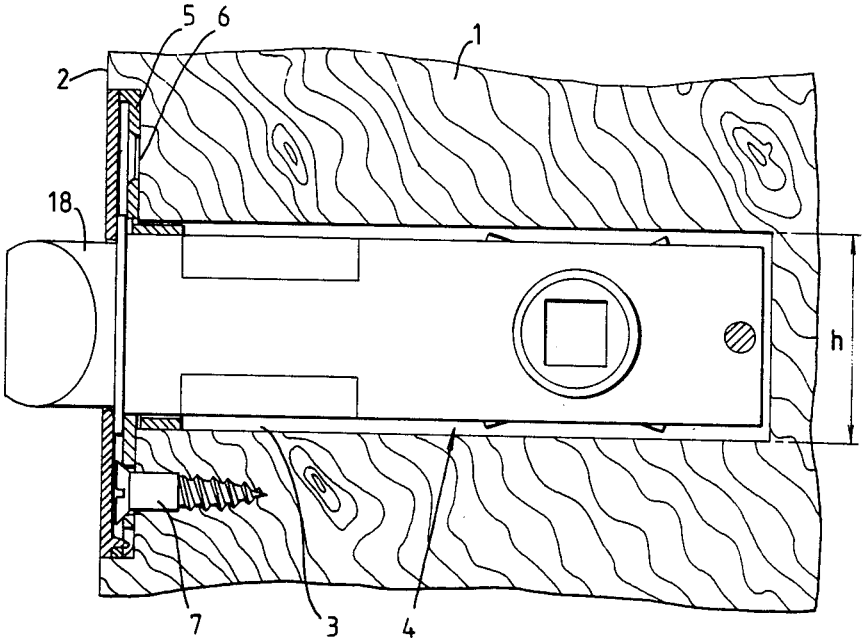
FIG. 1 is a front view, shown partly as a longitudinal section, of a lock having a locking member and installed in a leaf of a door.

FIG. 1 shows diagrammatically a part of a door leaf 1 which is generally in the form of a rebate at its front face 2 turned away from the hinge plates. Adjoining the front face 2 is a lock recess 3 formed in the door leaf 1 which serves to accommodate a lock 4 according to the invention and has a height h. At its end on the left in FIG. 1, the lock 4 is provided with a faceplate 5 in which holes 6 are formed for receiving fixing screws 7 by means of which the faceplate 5 is fixed to the front face 2.

According to FIGS. 2 to 5, the lock 4 includes an elongated case 8 with a longitudinal axis 9 with respect to which the faceplate 5 is arranged substantially perpendicularly. The faceplate 5 forms with the lock case 8 a housing for the lock and has a central opening 10. At the edge of this opening 10 and at the outer edge of the faceplate 5, recesses 11 with undercuts or punchedout portions are provided. The recesses 11 serve to receive spring snap hooks 12 provided with undercut lips and arranged on the back of a covering cap 14, so that the latter can be fastened to the faceplate 5 by introducing the snap hooks 12 into the recesses 11, as indicated in FIG. 1. The covering cap 14 has a central opening 15.

Figure 2:
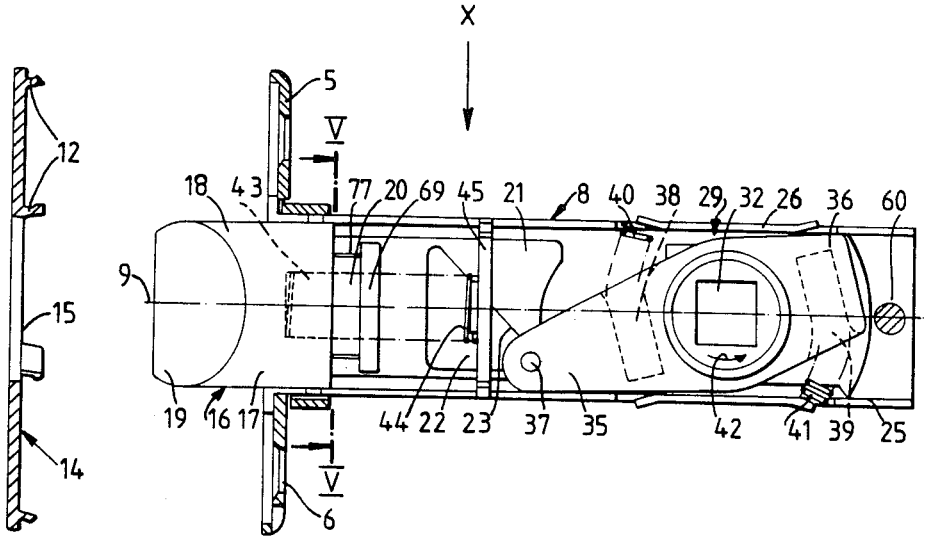
FIG. 2 is a front view, shown partly as a longitudinal section, of a lock according to the invention.
Figure 3:
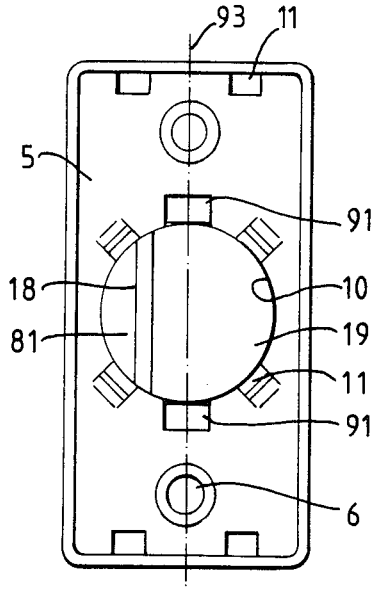
FIG. 3 is a side view of the lock according to FIG. 2 with the covering cap removed.

A locking member 16 is mounted to be slidable parallel to the longitudinal axis 9 in the openings 10 and 15 and the lock case 8 adjoining the faceplate 5 from the right in FIG. 2, the locking member having a shank 17 and a latch 18 at its end on the left in FIG. 2 which is provided with the usual lateral chamfer 19. At its end on the right in FIG. 2, the shank 17 has an extension 20 of reduced cross-section. At least one slide 21 likewise mounted to be slidable in the lock case 8 parallel to the longitudinal axis 9 is connected to the extension 20, the slide having at least on one wide side facing the longitudinal axis 9, a recess 22 defined on the right-hand side in FIG. 2 by a guide track 23 arranged obliquely with respect to the longitudinal axis 9 and moreover having a substantially triangular shape.

The lock case 8 is formed by a bottom housing wall 25, a top housing wall 26 and two side walls 27 and 28. A bush 29 is rotatably mounted between the two side walls 27, 28 and is provided on both sides with cylindrical, coaxial pivots 30 whose common central axis perpendicular to the longitudinal axis 9 forms the axis of rotation 31 of the bush 29 and which extend into openings of corresponding cross-section which are formed in the side walls 27, 28. The pivots 30, like the bush 29 itself, are provided with a preferably continuous receiving opening 32 for accommodating a spindle 33 indicated in broken lines in FIG. 4 and extending through at least one side wall of the lock case 8 into a handle 34 indicated diagrammatically in FIG. 4 for actuating the lock 4 and which may consist of a door push means, a rotary knob, an olive-shaped handle or knob or the like. The spindle 33 and the receiving opening 32 preferably have the conventional square cross-section.

The bush 29 is provided with a radially projecting lever arm 35 on its side facing the locking member 16 and with a likewise radially projecting lever arm 36 on its opposite side. Fitted at the outer end of the lever arm 35 is a driving pin 37 indicated in broken lines in FIG. 4, the driving pin being arranged parallel to the axis of rotation 31 and projecting into the recess 22 in the slide 21. Finally, as indicated in dash lines in FIG. 2, in the lever arms 35 and 36 of the bush 29, a blind hole 38 and a blind hole 39, respectively, which are open towards the bottom housing wall 25 and the top housing wall 26, respectively, are formed. Springs 40 and 41, respectively, are supported on the bottom of each of these blind holes 38, 39, the other ends of the springs being supported on the associated top and bottom walls 26 and 25, respectively, of the lock case 8. The bush 29 is biased by these springs 40, 41 in the direction of the arrow 42 (FIG. 2). The springs 40, 41 are preferably formed and arranged as compression springs. They serve as return springs which, after a rotation of the bush 29, turn it back into its normal position which can be seen in FIG. 2, in which the lever arm 35 bears against the bottom housing wall 25 with a relatively broad face.

The shank 17 and its extension 20 likewise have a blind hole 43 which is open towards the bush 29 and on the bottom of which a spring 44 is supported. The other end of this spring 44 is supported on a plate 45 inserted transversely of the longitudinal axis 9 into the bottom and top housing walls 25, 26. The locking member 16 is biased by the spring 44 into its advanced locking position visible in FIGS. 2 and 4, in which its latch 18 projects from the faceplate 5 and engages in a suitably formed recess in a frame part located opposite it. The spring 44 serves as a return spring for the locking member in order to push it back into the locking position after a shift into its retracted position.

The mode of operation of the lock described with reference to FIGS. 2 to 5 is described in detail hereinafter with reference to FIGS. 6 to 9.

In its normal position (FIGS. 6 and 7), the bush 29 is biased by the springs 40, 41 in the direction of the arrow 42 in such manner that the lever arm 35 bears against the bottom housing wall 25. At the same time, the spring 44 pushes the locking member 16 outwardly into the locking position, in which the driving pin 37 bears against the guide track 23 in the bottom right-hand corner in FIG. 6 of the recess 22. As a result, any further shifting of the locking member 16 outwardly is prevented, since it is coupled in mating fashion to the slide 21 in the sliding direction. The spring 44 acts additionally via the guide track 23 of the slide 21 on the driving pin 37 and forces the bush 29 into its initial position, so that the forces of the springs 40 and 42 restoring the handle 34 are reinforced by the force of the spring 44.

Figure 8:
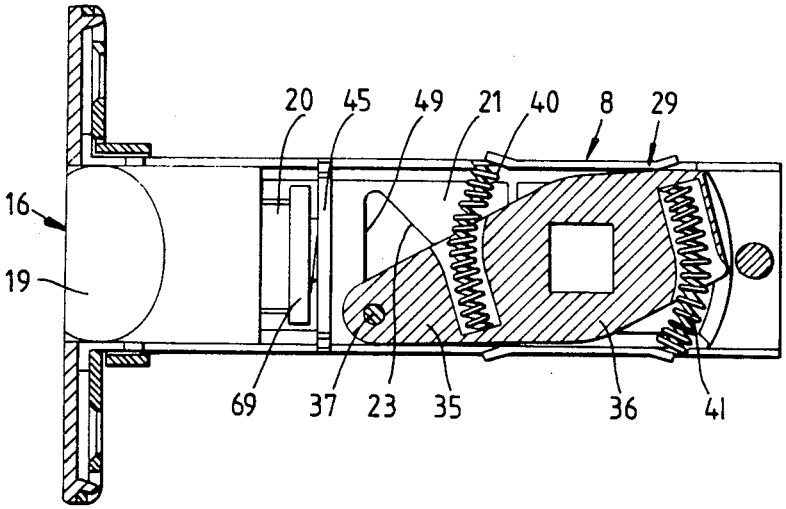
FIG. 8 is a longitudinal section, similar to FIG. 2, in the open position of the locking member produced by pressure thereon.
Figure 9:
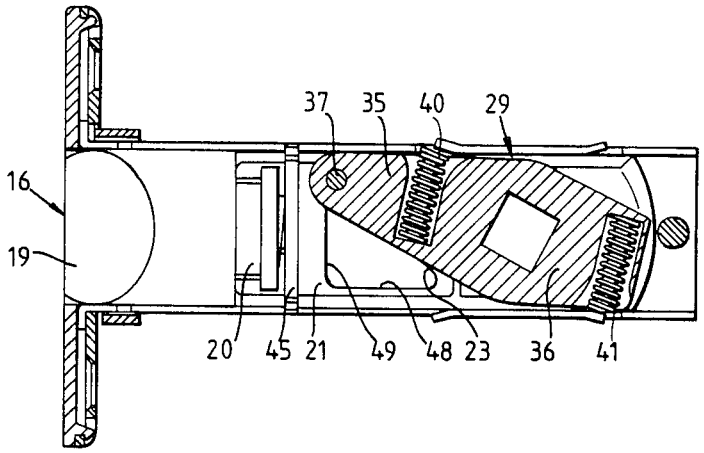
FIG. 9 is a longitudinal section, similar to FIG. 2, in the open position of the locking member produced by actuation of a handle.
Figure 10:
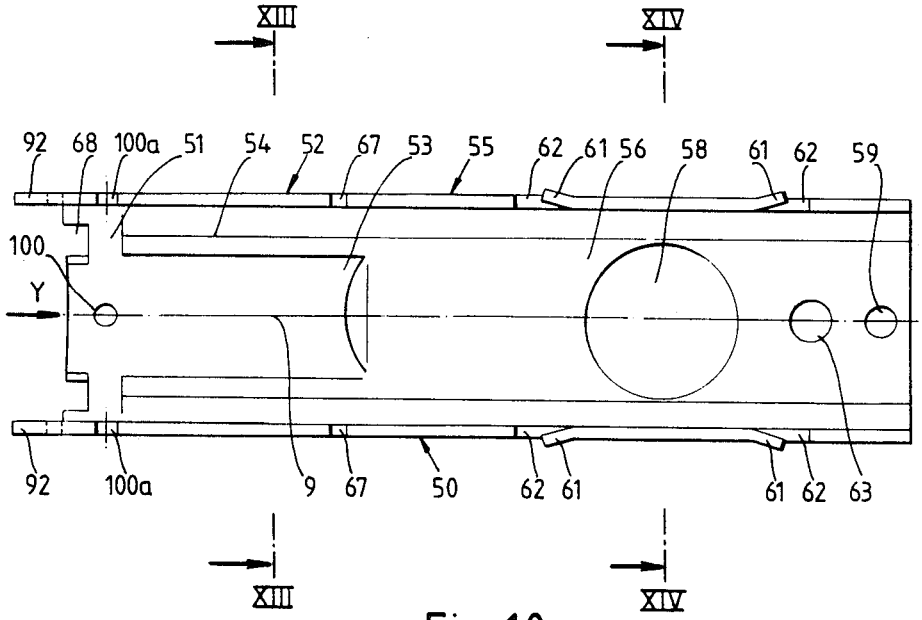
FIG. 10 is a front view of one half of the case of the lock according to FIG. 2 on a larger scale.
Figure 11:
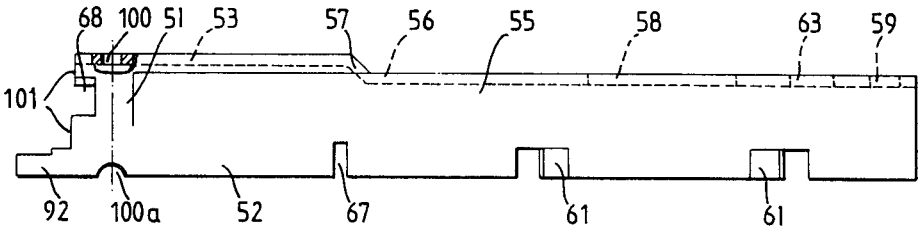
FIG. 11 is a plan view of the case half according to FIG. 10.

The locking member 16 can be pushed manually out of the normal position against the force of the spring 44 into the retracted open position which can be seen in FIG. 8, in which it is completely withdrawn into the lock case 8. In this operation, the bush 29 remains in its normal position which can also be seen in FIGS. 6 and 7, since the driving pin 37 slides along the bottom edge 48 of the recess 22 arranged parallel to the longitudinal axis 9. The possible shifting travel of the locking member 16 is predetermined by the length of the edge 48, since at the end of this shifting travel the driving pin 37 strikes against another edge 49 of the recess 22 extending perpendicularly to the edge 48. On release of the locking member 16, it returns into its locking position according to FIGS. 6 and 7 under the force of the spring 44. The locking member 16 is shifted in corresponding manner when, on the open door leaf 1 being banged shut, the chamber 19 of the locking member runs up onto a striking plate fixed to the frame and thereafter snaps into the hole provided therein.

If a closed door leaf or the like is to be opened, the bush 29 must be turned with the handle 34 in the direction opposite to that of the arrow 42 and against the force of the springs 40, 41. In this way, the driving pin 37 slides along the inclined guide track 23 and in so doing draws the locking member 16 connected to the slide 21 and, consequently, also the latch 18 into the open position. The end of this movement is reached when the driving pin 37 strikes against the edge 49, which connects the ends of the guide track 23 and the edge 48. On release of the handle 34, the bush 29 and, therefore, the handle 34 coupled to it by way of the spindle 33 are swung back into the normal position by the force of the springs 40, 41, while at the same time the locking member 16 is moved back into the locking position by the force of the spring 44 until the driving pin 37 is again arranged in the right-hand bottom corner of the recess 22. Correspondingly, the door leaf can be closed by operating the handle 34.

A particularly preferred embodiment of the lock according to the invention, which brings further advantages with it in addition to the advantages already described, is described in detail hereinafter with reference to FIGS. 2 to 30.

Figure 12:
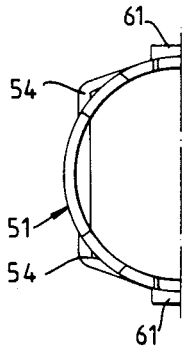
FIG. 12 is a side view of the case half in the direction of an arrow Y in FIG. 10.
Figure 13:
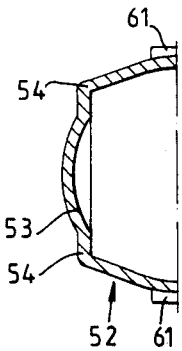
FIGS. 13 and 14 are sections on the lines XIII—XIII and XIV—XIV in FIG. 10.
Figure 14:
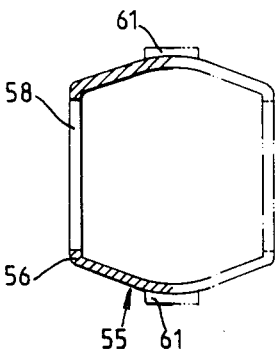

To simplify manufacture of the lock housing, the lock case 8 suitably consists of two identical halves 50 (FIGS. 10 to 14), which, like the faceplate 5 produced independently thereof, are manufactured by combined punching, stamping and bending operations from sheet-metal strip. Observed from the left in FIGS. 10 and 11, each case half 50 comprises first a substantially hollow- and semi-cylindrical portion 51 (FIG. 12). The portion 51 is followed by a portion 52 (FIG. 13) having in cross-section roughly the shape of a half hexagon, a part 53 forming one side wall of the lock case extending, however, substantially along a hollow cylindrical surface whose radius corresponds to the radius of the portion 51. The corners of the hexagon which are located at the sides of the case halves 50 form ribs 54 extending parallel to the longitudinal axis 9 which project radially beyond the external cross-section of the hollow cylindrical portion 51. Finally, the portion 52 is adjoined by a portion 55 whose cross-section extends along a half hexagon (FIG. 14) and corresponds to the cross-section of the portion 52 except for the difference that a part 56 forming one side wall of the lock case 8 consists of a plane-parallel sheet-metal strip portion. A shoulder 57 is therefore present at the transition between the portions 52 and 55 and at the transition between the parts 53 and 56. Moreover, a circular opening 58 for receiving one of the pivots 30 (FIG. 4) is formed in the part 56. Another opening 59 in the part 56 serves to receive a connecting pin 60 (FIG. 5) by means of which the two case halves 50 are riveted together at the right-hand end in FIG. 4.

At parts which form the top and bottom housing walls 25, 26 after assembly, lugs 61 are punched out on both sides of the opening 58 in each case, through which lugs holes 62 are produced. Through these holes 62, one of the ends of each of the springs 40, 41 (FIG. 2) is supported on the associated lug 61.

Between the openings 58 and 59, each case half 50 has another opening 63. In accordance with FIG. 4, this opening serves in each instance to receive a projection 64 on a respective half bearing 65 of plastic which is arranged between the bush 29 and the associated side wall 27 or 28 of the lock case 8 and through which the associated pivot 30 of the bush 29 projects. The bearing halves 65 preferably consist of polyamide and form a wear-resistant bearing for the bush 29. At the right-hand end in FIG. 4, the bearing halves 65 have portions 66 which embrace the lever arm 36 of the bush 29, bear against one another and define the width of the lock case 8.

Notches 67 in the two case halves 50, which form slot-shaped openings after their assembly, serve to attach the plate 45 (FIGS. 2 and 4), which is provided with corresponding projections for the purpose. Finally, additional notches or cutouts 68 at the front ends of the case halves 50 serve to create free spaces for the snap hooks 12 of the covering cap 14 when it is mounted on the faceplate 5.

As shown in FIGS. 2 to 9, a combined lever and wedge drive having as driving parts substantially the already described components 21, 22, 23, 35 and 37 serves for converting the rotary movements of the bush 29 into sliding movements of the locking member 16, the lever arm 35 acting as the lever and the guide track 23 acting as the wedge. In accordance with FIG. 4, in order to increase the stability of the drive, on that side of the extension 20 which is diametrically opposite the slide 21, a corresponding slide **21*a* having a recess 22*a* corresponding to the recess 22 is slidably mounted. The driving pin 37 moreover consists of a pin projecting through the lever arm 35 and rotatably mounted therein and which, in accordance with FIG. 4, extends into the recesses 22, 22***a* of the two slides 21, 21*a* and cooperates with their parallel guide tracks 23, 23*a*.

By reason of its lever and wedge drive, the lock according to the invention is not optionally suitable for application in doors or the like hingeing on the right and on the left, to such extent as it has a latch. Moreover, doors or the like are frequently provided with an obliquely extending rebate, which makes it necessary to provided in addition locks whose faceplates 5 are arranged correspondingly obliquely with respect to the longitudinal axis 9.

Therefore, in the particularly preferred embodiment of the lock, the locking member 16, on the one hand, is rotatably mounted in the lock case 8 and, on the other hand, an arrangement is provided by means of which the faceplate 5 can be swivelled, so that the same lock design can be employed for doors or the like turning to the right and to the left and also for straight and inclined rebates.

For rotatable mounting of the locking member 16, the locking member 16 and the slides 21, 21*a* are not made in one piece or fixed securely to one another to form one piece, but are connected together by coupling elements which cooperate in the direction of the longitudinal axis 9, but allow rotation of the locking member 16 relative to the slides 21, 21*a* about the longitudinal axis 9.

Figure 15:
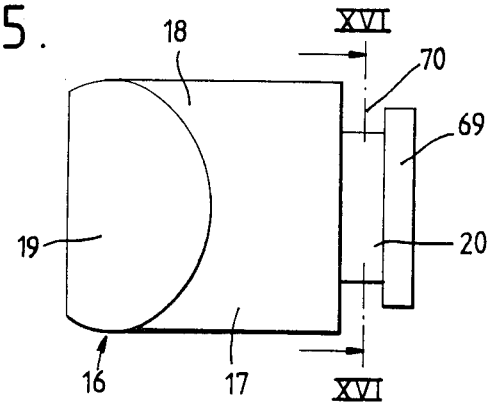
FIG. 15 is a front view of the locking member of the lock according to FIG. 2 on a larger scale.
Figure 16:
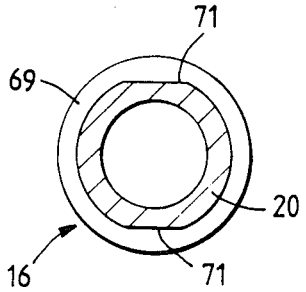
FIG. 16 is a section on the line XVI—XVI in FIG. 15.
Figure 17:
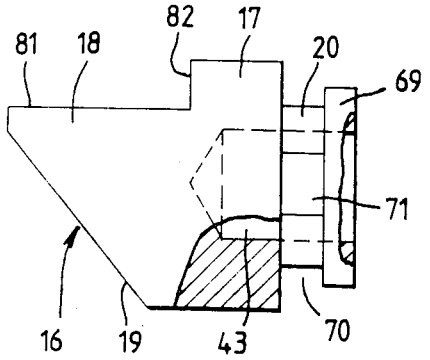
FIG. 17 is a plan view, partly in section, of the locking member according to FIG. 15.

According to FIGS. 15 to 17, the shank 17 consists of a cylindrical body rotatably mounted in the hollow cylinder which is formed by the semi-cylindrical portions 51 of the two case halves 50 connected to one another. The coaxial cylindrical extension 20 of the shank 17 has a considerably smaller diameter than the shank 17 and is provided at its end facing the bush 29 with a radially projecting cylindrical collar 69, the diameter of which is a little smaller than the diameter of the shank 17. In this way, there is formed between the shank 17 and the collar 69 an encircling groove 70 which preferably has at two diametrically opposite points two plane, parallel stop surfaces 71 (FIGS. 16 and 17).

Figure 4:
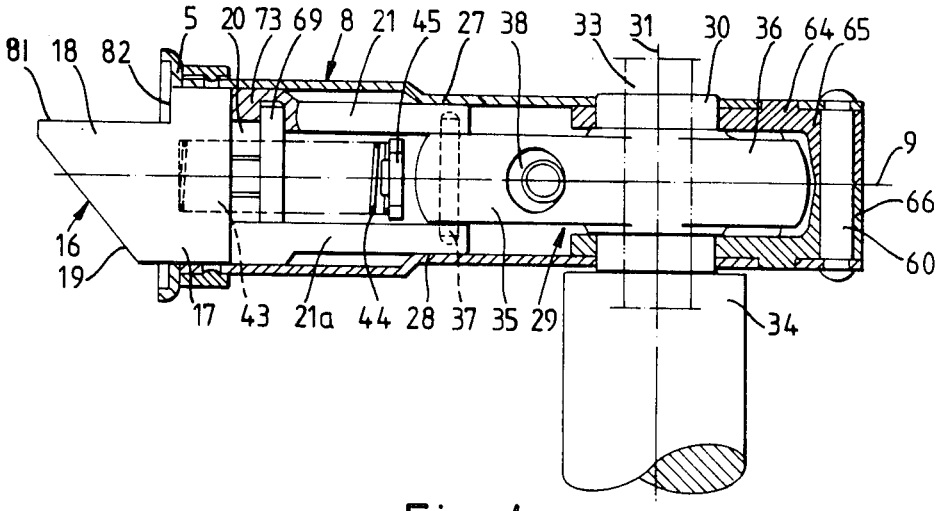
FIG. 4 is a plan view, shown partly as a longitudinal section, of the lock according to FIG. 2 in the direction of an arrow X.
Figure 5:
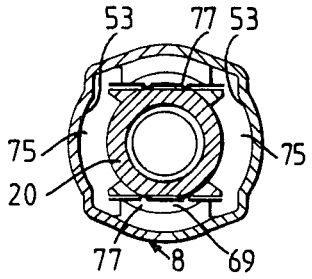
FIG. 5 is a section along the line V—V of FIG. 2.
Figure 6:
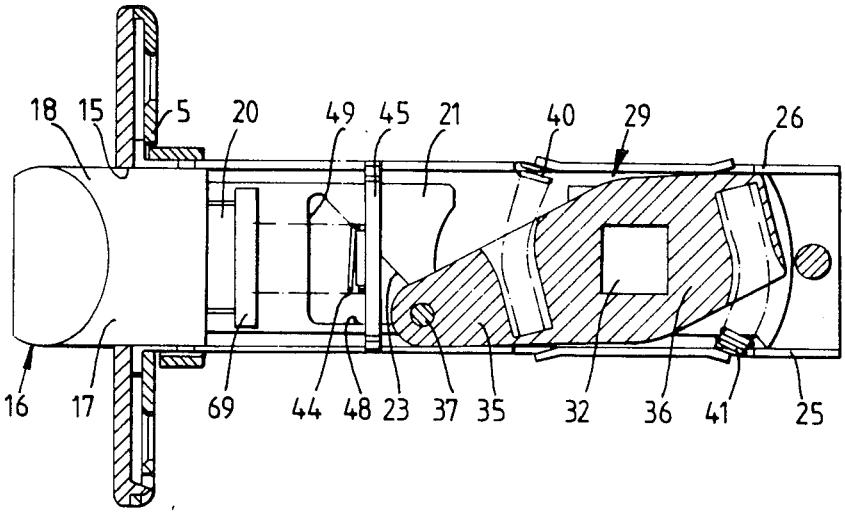
FIGS. 6 and 7 are longitudinal sections similar to FIGS. 2 and 4 in the locking position of the locking member.
Figure 7:
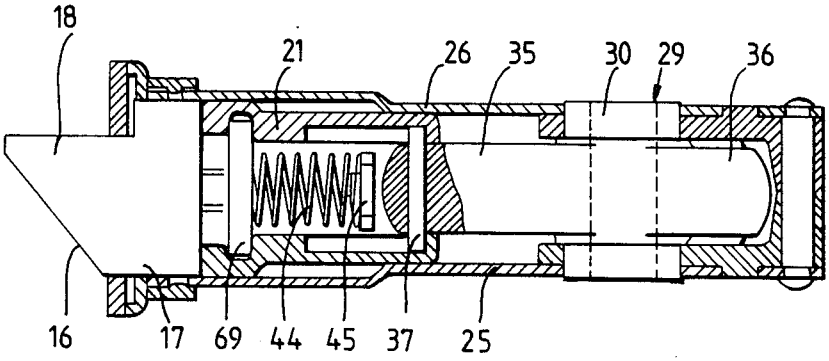

According to FIGS. 18 to 21, the slide 21 consists substantially of a plane-parallel plate, in the front of which the recess 22 is formed. At its end facing the shank 17, the slide 21 has a ridge 73 whose outer surface projects convexly with respect to the plane surface of the rest of the slide 21 and extends along an imaginary cylinder surface, the radius of which corresponds to the internal radius of the parts 53 of the two case halves 50, so that their inner faces form bearing and sliding surfaces for the ridge 73 (FIG. 4). On its underside, the ridge 73 has a groove 74 extending along a cylindrical surface and the radius of which corresponds to the radius of the collar 69, so that, in accordance with FIG. 4, the collar can be inserted over a part of its circumference into the groove 74. On its side towards the shank 17, the groove 14 is defined by a wall portion 75 extending along a cylindrical surface whose radius corresponds to the radius of the cylindrical part of the groove 70. The parts 69, 70 of the locking member 16 and the parts 74, 75 of the slide 21 consequently form coupling elements by means of which the slide 21 is coupled to the locking member 16 in the direction of the longitudinal axis 9, but can be rotated relative to the latter. Preferably, the parts 69, 70, 74 and 75 are moreover so dimensioned in the direction of the longitudinal axis 9 that the locking member 16 and the slide 21 are connected in this direction through mating contact. The slide 21*a* is correspondingly connected to the locking member 16.

Moreover, at the two ends of the wall portion 75, axial slots 76 (FIGS. 18, 21) are provided. These serve to receive in each case one of the ends of small flat springs 77 (FIG. 23) whose other ends are arranged in corresponding slots 78 of the opposite slide 21*a*. The flat springs 77 have two corrugations 79, the distance between which is a little smaller than the length of the stop surface 71 of the groove 70. In the assembled state, these two corrugations 79 of the pretensioned flat spring 77 bear tightly against the ends of the stop surfaces 71. Two selected stop positions for the locking member 16 are thereby provided, namely the position which can be seen in FIG. 4 and the position which can be reached by a 180° rotation of the locking member about the longitudinal axis 9. The position to be produced in any individual case depends on the side of the door leaf or the like towards which the chamfer 19 of the latch 18 is to be directed. In both positions, the locking member 16 engages perceptibly by reason of the flat springs 77.

The assembly unit formed by the slides 21 and 21*a*, the collar 69, the extension 20 and the flat springs 77 is held together inside the lock case 8 owing to the fact that the curved outer surfaces of the ridges 73 bear and slide against the parts 53 of the case halves 50 and the plane surfaces of the slides 21, 21*a* bear and slide against the likewise plane parts 56 (FIG. 11) of the case halves 50. The shifting travel of the slides 21, 21*a* towards the bush 29 is moreover defined by the shoulders 57.

So that the particular position of the latch 18 is prescribed not merely by the flat springs 77, but is also ensured by other auxiliary means, the locking member 16 has a recess on its side diametrically opposite the chamfer 19, by which recess a plane surface 81 (FIGS. 4, 17), and a shoulder 82 at right angles thereto are created. Moreover, in the corresponding zone, the covering cap 14 has a segment 83 (FIG. 24) corresponding to the size of the shoulder 82 and projecting into the opening 15. When the covering cap 14 is pressed onto the faceplate 5 of the assembled lock 4, the free end of this segment 83 is located closely opposite the surface 81 and covers the shoulder 82 at the same time. As a result, rotation of the locking member 16 after final fitting is no longer possible. The shoulder 82 is moreover spaced sufficiently far from the free end of the latch 18, so that the latter can adopt its locking position even when the covering cap 14 has been snapped on. If it is desired to lock the latch 18 in a position turned through 180°, the locking member 16 is turned accordingly before the fitting of the covering cap 14 and, in contrast to FIG. 24, the covering cap 14 is mounted on the faceplate 5 in a position turned through 180°. The covering cap 14 moreover has the function of masking the fixing screws 7 and the faceplate 5. It is advantageously matched at least in colour to the particular handles 34 in order also to achieve an attractive appearance.

The arrangement for swivelling the faceplate 5 is necessary since there are door leaves or the like whose rebates are not at right angles to the plane wide sides of the door leaves or the like, but are disposed at an angle of e.g. 3.5° with respect thereto. To begin with, therefore, the arrangement has vertically above and below the centre of the opening 10 of the faceplate 5 two cutouts 91 (FIG. 3) adjoining the opening 10 and two lugs 92 on each case half 50 (FIGS. 10, 11) which are introduced into the cutouts 91 and then bent over radially. This connection nevertheless has so much play that the cutouts 91 and the bent-over lugs 92 form a swivel bearing for the faceplate 5, the swivel axis 93 (FIG. 3) being arranged at right angles to the longitudinal axis 9 and at right angles to the axis of rotation 31 of the bush.

FIG. 25 shows one of the lugs 92 in the still unbent state. A hollow cylindrical adjusting ring 94 has a plane end face 95 at its end turned towards the only partly shown lock case 8 and, at its end turned towards the faceplate 5, has an end face 96 which encloses an angle of e.g. 3.5° with the end face 95. In accordance with FIGS. 25 and 26, the adjusting ring 94 is mounted on the cylindrical portion of the lock case 8 which is formed in the assembled state by the semi-cylindrical portions 51 of the two case halves 50 and is defined by the ribs 54 which, on that side which faces the adjusting ring 94, have abutment surfaces which are arranged in a plane extending perpendicularly to the longitudinal axis 9. After the introduction of the lugs 92 into the cutouts 91 and after their bending over, the adjusting ring 94 is rotatably mounted between the faceplate 5 and the abutment surfaces of the ribs 54 (FIG. 26).

In accordance with FIG. 25, in a marginal zone bordering the opening 10 and facing the adjusting ring 94 and which extends along a semi-circle, the faceplate 5 has a circular surface 97 chamfered by e.g. 3.5° with respect to the longitudinal axis 9 in correspondence with the design of the adjusting ring 94. According to FIG. 25, between its ends 97*a* and 97*b*, this circular surface extends over the upper half of the opening 10, but of course could also extend over its lower half. The distance between the faceplate 5 and the abutment surfaces of the ribs 54 is moreover so chosen that the adjusting ring 94, in its fitted state and when its thickest part marked by an arrow 98 is located at the top, bears with the upper half of its end face 96 against the circular surface 97, while the lower half of the end face 96 is at a slight distance from the faceplate 5. This position corresponds to the vertical position of the faceplate 5 with respect to the longitudinal axis 9 and to its parallel position with respect to the axis of rotation 31 and can be defined by a locking ball 99 at the inner face of the adjusting ring 94 which engages in a hole 100 in the cylindrical portion of the lock case 8.

If the adjusting ring 94 is turned out of the described position through 90° to one side or the other, then its widest part marked by the arrow 98 travels on the circular surface 97 towards one of the two ends 97*a* or 97*b*. The result of this is that the widest part of the adjusting ring 94 is forced into the increasingly narrowing gap between the faceplate 5 and the ribs 54 and the faceplate is thereby swivelled about the swivel axis 93. This is possible owing to the fact that the end faces 101 of the case halves 50 (FIG. 11) which adjoin the faceplate 5 are likewise chamfered by an angle of e.g. 3.5° in order to create sufficient free space for the swivelling movement. When the thickest part of the adjusting ring 94 reaches one of the ends 97*a*, 97*b* of the circular surfaces 97, then the other end for the time being of the circular surface 97 bears against that part of the end face 96 which corresponds to the narrowest part of the adjusting ring 94. As a result, in accordance with the rebate on the door leaf or the like, the faceplate 5 automatically adopts the inclined position of e.g. 3.5° with respect to the longitudinal axis 9 which is preset by the inclined end face 96 of the adjusting ring 94. The two positions of the adjusting ring 94 corresponding to the ends 97*a*, 97*b* of the circular surface 97 can likewise be secured by locking balls 99 and holes 100 in the lock case 8. According to FIGS. 10 and 11, an hole 100 and two half holes 100a are provided for this purpose in each of the two case halves 50, so that after the assembly of these two halves 50 four holes arranged at intervals of 90° are present, of which as a rule only three are needed. If the adjusting ring 94 preferably consists of plastic, deformable studs projecting radially inwardly may also be provided in place of the locking balls 99. Alternatively, it is possible to dispense with the locking balls or studs if continuous adjustment of the position of the faceplate 5 is desired.

Figure 27:
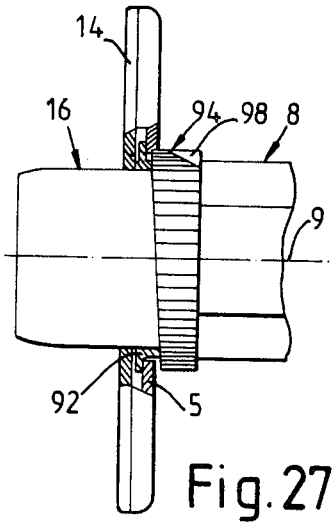
FIGS. 27 to 30 are front views and plan views, respectively, of the arrangement according to FIGS. 25 and 26 in different operational positions.
Figure 29:
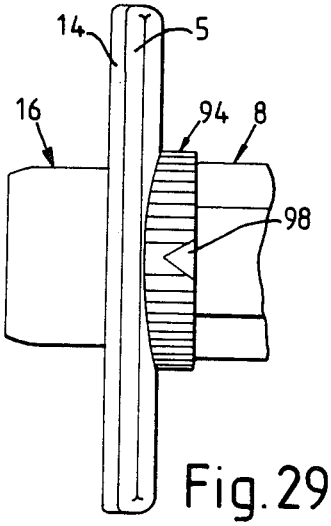
Figure 28:
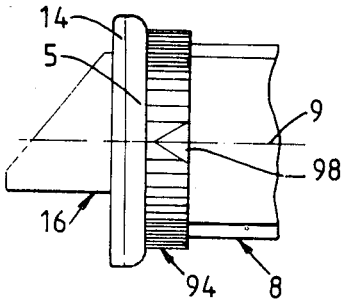
Figure 30:
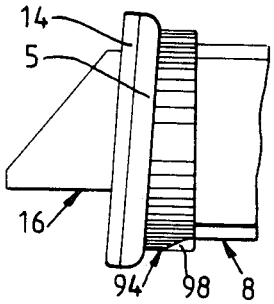

FIGS. 27 and 28 show the faceplate 5 diagrammatically in its unswivelled position perpendicular to the longitudinal axis 9 and parallel to the axis of rotation 31, as is necessary for the use of the lock with a straight rebate, while FIGS. 29 and 30 show the faceplate 5 after swivelling thereof about the swivel axis 93 in a swivelled position with respect to the longitudinal axis 9, which is reached after rotation of the adjusting ring 94 through 90° and is required for use with an inclined rebate.

Figure 31:
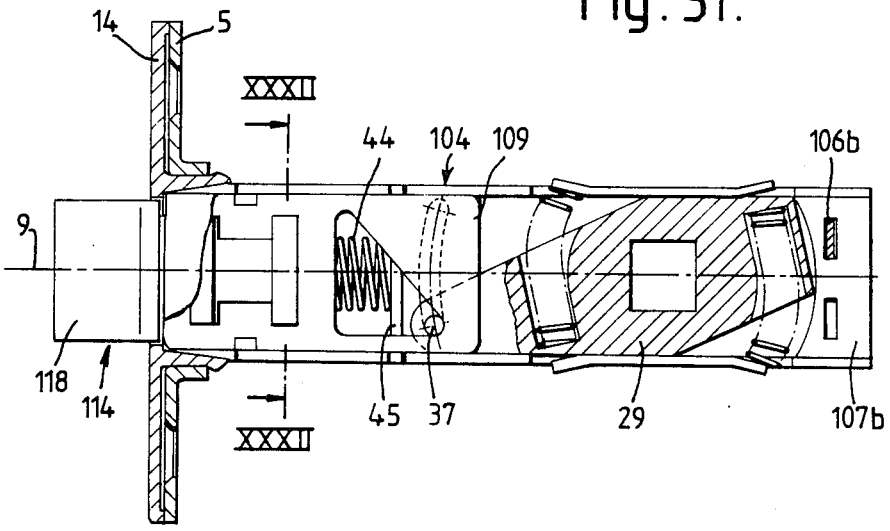
FIG. 31 is a front view, shown partly in longitudinal section, of a second embodiment of the lock according to the invention.
Figure 32:
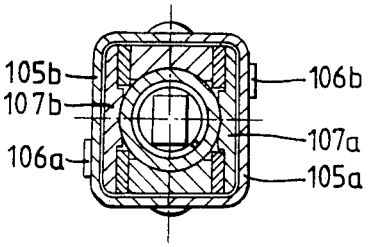
FIG. 32 is a section on the line XXXII—XXXII in FIG. 31.

Another embodiment of the invention is shown in FIGS. 31 to 37. A lock case 104 of substantially square cross-section consists of two identical U-shaped halves 105*a*, 105*b* (FIG. 32). At one end, the case halves 105*a*, 105*b* are attached by means of bent-over lugs to the faceplate 5 onto which the covering cap is pressed, corresponding to FIG. 25. At the opposite end, each of the case halves 105*a*, 105*b* has a strap element 106*a*, 106*b*, respectively, bent over at right angles which projects through an aperture in the respectively other case half 105*a*, 105*b* and is then bent over again at right angles outside thereof. At the two side walls of the lock case 104 there are arranged bearing halves 107*a*, 107*b* preferably consisting of polyamide and which, on the one hand, keep the two case halves 105*a*, 105*b* apart and, on the other hand, comprise cylindrical bearing bodies 108 for mounting the pivots 30 of the bush 29, these bearing bodies 108 being arranged and centered in corresponding openings in the case halves 105*a*, 105*b*. The bearing halves 107*a*, 107*b* extend towards the faceplate 5 as far as the plate 45 supporting one end of the spring 44.

Figure 33:
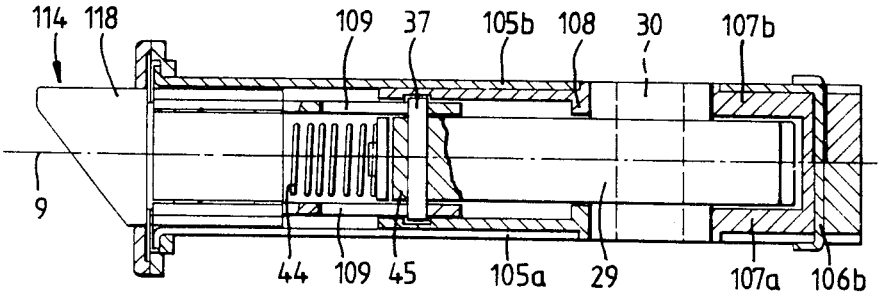
FIG. 33 is a plan view, shown partly in longitudinal section, of the lock according to FIG. 31.

According to FIGS. 31 to 37, in contrast to FIGS. 2 to 5, in which the slides 21, 21*a* preferably consist of forged metal parts, two slides 109 and provided which consist of plane-parallel sheet-metal strips produced by punching. In accordance with FIGS. 36 and 37, each of these strips has an opening 110 in the form of a punched-out hole with an outline corresponding to the outline of the recesses 22 (FIG. 18), and an elongated punched-out opening 111 which is open towards the side away from the opening 110. Recesses 112, 113 extending at right angles to the longitudinal axis of the punched-out opening 111 adjoin this opening 111 at a distance apart and on both sides. So that the driving pins 37 may extend right through the thin slides 109, the bearing halves 107*a*, 107*b* have the recesses shown in dash lines in FIG. 31, in which the outer ends of the driving pins 37 are slidably guided, as is also shown in FIG. 33.

According to FIGS. 34 and 35, a locking member 114 has a rear cylindrical shank 115 having two radially projecting, likewise cylindrical collars 116, 117 spaced apart in the direction of the longitudinal axis of the shank, the distance between which collars corresponds to the distance between the recesses 112 and 113. The width of these collars 114, 115 is so determined that the slides 109 slidably mounted at the side walls of the lock case 104 can be pushed from the side onto the collar 116 with their recesses 112 and onto the collar 117 with their recesses 113 and are thereafter coupled to the latch shank 115 in the sliding direction. The recesses 112, 113 and the collars 116, 117 are preferably so formed that they form coupling element acting in mating contact in the direction of the longitudinal axis 9. Moreover, the length of the shank 115 is so chosen that, in the locking position of the locking member 114, the shank terminates flush with the faceplate 5 and a latch 118 of square cross-section is arranged outside the lock case 104. The locking member 114 can therefore also be turned into the desired position in the fitted state, as long as the covering cap 14 has not yet been put on. If the covering cap 14 is thereafter fitted, this having in this case a corresponding square opening for accommodating the latch 118, then the desired latch position is locked. The shank 115 has a blind hole 119 (FIG. 34) on its back for partially accommodating the spring 44.

For the rest, the operation of the lock according to FIGS. 31 to 37 corresponds substantially to that of the lock according to FIGS. 2 to 5 and therefore does not require to be separately explained.

Figure 38:
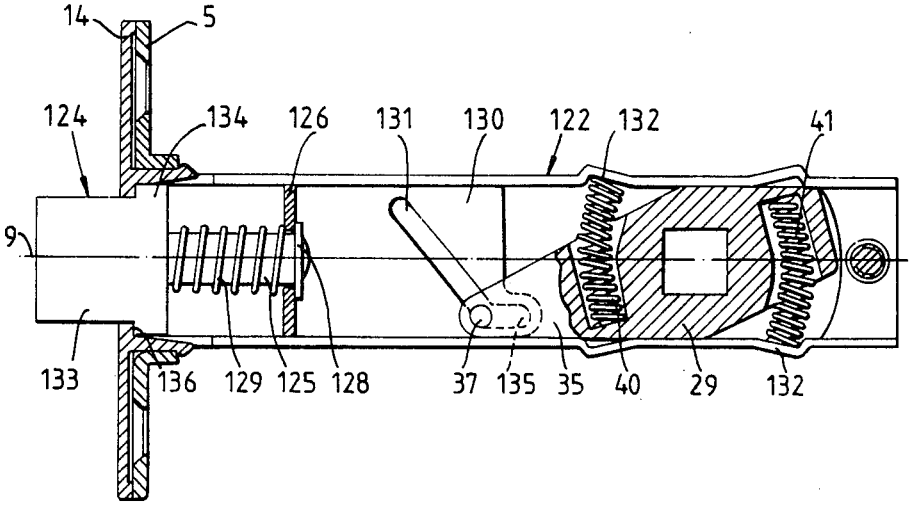
FIGS. 38 and 39 are a front view and a plan view, shown partly as a longitudinal section in each case, of a third embodiment of the lock according to the invention.
Figure 39:
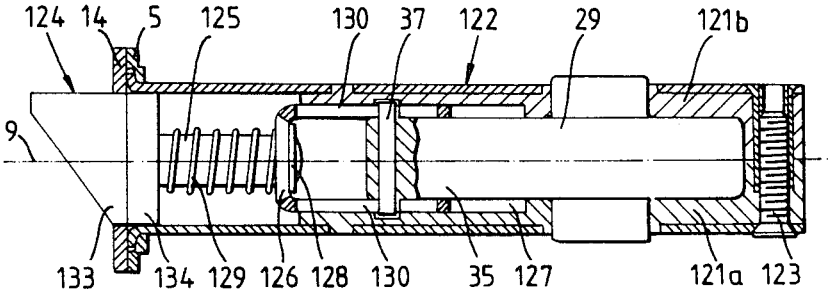

In the embodiment according to FIGS. 38 and 39, the bush 29 is mounted between two identical bearing halves 121*a*, 121*b*, preferably consisting of polyamide, which, similarly to FIGS. 31 to 33, are arranged at the side walls of a lock case 122 of substantially square cross-section. The lock case is composed of two identical halves which are connected at one end by a screw 123 and are attached at the other end to the faceplate 5.

At its face directed towards the bush, a locking member 124 has a shank 125 of reduced cross-section whose free end projects loosely through the crosspiece 126 of a U-shaped slide 127 (FIG. 39) and is secured against withdrawal at its rear by a stop 128 which is produced, for example, by means of a Seeger ring or the like mounted on the shank. A spring 129 operative as a compression spring is drawn onto the shank 125 between the locking member 124 and the crosspiece 126. Consequently, unlike the other two embodiments, the components 125, 126 and 128 form coupling elements which do not act in mating contact in both directions of movement of the locking member 124.

Figure 18:
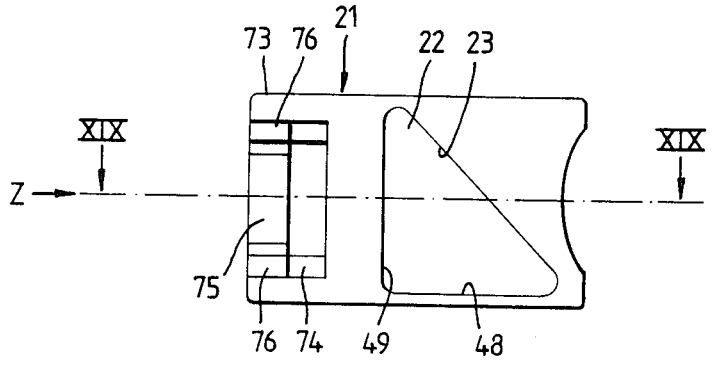
FIG. 18 is a front view of a slide of the lock according to FIG. 2 on a scale corresponding to FIGS. 15 to 17.
Figure 19:
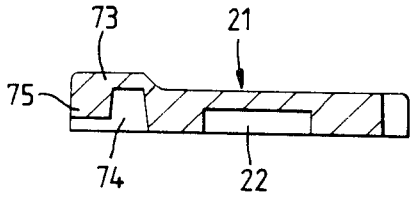
FIG. 19 is a section on the line XIX—XIX in FIG. 18.
Figure 20:
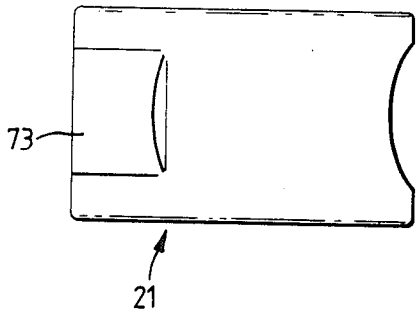
FIG. 20 is a rear view of the slide according to FIG. 18.
Figure 21:
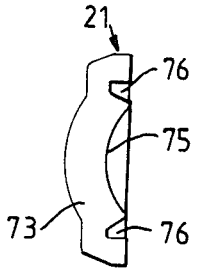
FIG. 21 is a side view of the slide in the direction of an arrow Z in FIG. 18.
Figure 22:
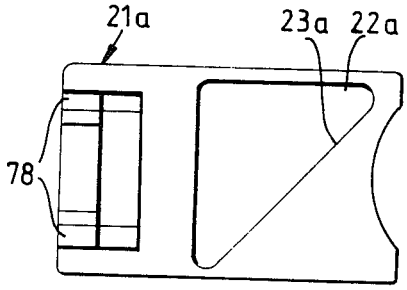
FIG. 22 is a front view of another slide of the lock according to FIG. 2 on a scale corresponding to FIG. 18.
Figure 23:
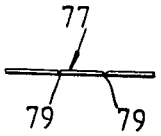
FIG. 23 is a side view of a flat spring of the lock according to FIG. 1 on a scale corresponding approximately to FIG. 15.

Two arms 130 of the U-shaped slide 127 are slidably mounted between the bearing halves 121*a* of the bush 29 and they each have a guide track 131 extending obliquely with respect to the longitudinal axis 9 and in the form of a groove or a slot with a width preferably corresponding substantially to the diameter of the driving pin 37. This guide track 131, into which the driving pin 37 of the bush 29 projects, has the same function as the guide track 23 (FIGS. 2, 18). The springs 40, 41 holding the bush in its normal position are supported on surfaces 132 which are obtained by forcing out the side walls of the lock case 122, which is preferably made of sheet metal.

The operation of the lock according to FIGS. 38 and 39 is similar to that of the lock according to FIGS. 2 to 5. In the normal position of the bush 29 which can be seen in FIG. 38, the driving pin 37 is located at the bottom right-hand end of the guide track 131, while the locking member 124 is forced into its locking position by the action of the spring 129, in which position the stop 128 bears against the crosspiece 126. If the locking member is to be drawn back by actuating the bush 29, the latter is turned in opposition to the action of the springs 40, 41, the driving pin 37 sliding along the guide track 131 as far as its top end on the left in FIG. 38 and the slide 127 being drawn back and, consequently, also the locking member 124 towards the bush 29 at the same time by means of the stop 128 bearing against the crosspiece 126. After the release of the bush 29, this and the locking member return to the normal and locking positions, respectively, under the joint action of the springs 40, 41 and 129. If the locking member 124 is to be drawn back without actuating the bush 29, for example when a door leaf or the like is slammed shut, this is possible owing to the fact that the shank 125 is pushed through the crosspiece 126 in opposition to the force of the spring 129 and in the process the stop 128 is lifted away from the crosspiece. On release of the locking member 124, it returns automatically to its locking position under the action of the spring 129.

Rotation of the locking member 124 for the purpose of selective arrangement of its latch 133 or the like at the right or left side of a door or the like is also possible in the case of the embodiment according to FIGS. 38 and 39. To this end, the latch 133 has a short extension 134 which is guided in the lock case 122 and, like this, is of square cross-section. At its bottom right-hand end in FIG. 38, the guide track 131 has an extension 135 running parallel to the longitudinal axis 9 and with a length corresponding to the length of the extension 134. The locking member 124 can therefore be withdrawn from the lock case 122 still further to the left out of the locking position according to FIG. 38 until the extension 134 is exposed and then be turned through 180°, since in this instance the shank 125 is either of cylindrical form or is arranged in a suitably larger opening in the crosspiece 126. Moreover, the latch 133 may merge into the extension 134 by way of a shoulder 136 projecting outwards radially and which, after fitting, is applied against an abutment surface of the covering cap 14, so that with the covering cap 14 put on, withdrawal and adjustment of the latch 133 is impossible.

Finally, all the driving parts in the embodiment according to FIGS. 38 and 39, namely in particular the component parts 35, 37, 126, 127 and 130, are also located between the locking member 124 and the bush 29 both in the locking position and in the open position of the locking member.

In the embodiments according to FIGS. 31 to 37 and 38 and 39, the arrangement having the adjusting ring 94 (FIGS. 25 to 30) for adjusting the faceplate 5 is absent, although it could likewise be applied in addition in a similar manner.

In all the described embodiments, the lock according to the invention has a large number of advantages. A particularly important advantage consists in that the cross-section (diameter) of the bush 29 may correspond practically to the distance between the top and bottom case walls and the bush can therefore be made very sturdy. If, for example, the lock cases 8, 104 and 122 have heights (corresponding to the dimension h in FIG. 1) or full-width envelope diameters to about 25 mm in conjunction with a wall thickness of about 1 mm necessary for sufficient stability, then it can easily be established therefrom, taking into consideration the conventional spindle size of 8 mm, that the wall thicknesses of the bush are still sufficiently large even in the thinnest places. All the driving parts coupling the locking member to the bush, in particular the slides 21, 21*a*, 109 and 127, the lever arm 35 and the driving pin 37, are arranged in every working position in a space in the lock case which is between the locking member and the bush, so that no free space for accommodating any driving parts needs to be provided between the bush 29 and the bottom and top case walls. The same applies as regards other operating parts, e.g. the lever arm, the springs 40, 41 and the various coupling elements, which can either be accommodated in the same space as the driving parts or else on the side of the bush 29 remote therefrom. By reason of the design of the drive as a combined lever and wedge drive, even with very small lock dimensions of, for example, about 25 mm in cross-section at the most, with a small angle of rotation of the bush of 28°, for example, a large stroke of the locking member of, for instance, about 12.5 mm can moreover be attained, which is desirable in particular when handles in the form of convention door push means are employed. Furthermore, favourable restoring moments are obtained, since the return springs described can be made sufficiently strong. As regards stability, it is moreover advantageous that the turning movement of the bush 29 to both sides can be limited by abutment of its lever arms 35 and 36 against the associated case walls 25 and 26, respectively, which makes large abutment surfaces possible. In addition, wear is relatively slight, since only few driving and operating parts are needed. By mounting the driving pin 37 rotatably in the lever arm 35, for example, and through its thereby possible rolling friction on the guide tracks 23, 23*a* and 131, the wear can be reduced still more. Furthermore, the manufacture of locks with different spindle sizes, that is to say different distances between the axis of rotation 31 and the faceplate 5, is possible with the simplest means, since for this purpose only lock cases 8, 104 or 122 of correspondingly different length and locking members 16, 114 or 124 of correspondingly different length are required, while all the other components, in particular the driving parts, can remain unchanged.

The invention is not restricted to the embodiments described, which can be modified in various ways. For example, it would be possible to produce locks with locking members mounted non-rotatably in the housing, for instance by making the latter in one piece with the slides or coupling them non-rotatably or fixedly to the slides. Such locks could be produced in two types for doors hingeing on the right or left by using the slides in the arrangement which can be seen in FIG. 2 (or FIGS. 31 and 38) for one type of lock, while in the other locks the slides 21 are replaced by the slides 21*a*, or conversely, so that the locking member is drawn back by an opposite rotation of the bush. Moreover, locks with non-rotatable locking members could be employed exclusively as bolt-type locks, the locking members of which do not have any chamfers 19 (FIG. 4). Lastly, it would also be possible to provide the slides in each case with two inclined guide tracks starting from the longitudinal axis 9 and which extend away from the longitudinal axis in both directions towards the locking member, in which case the driving pin 37 is arranged on a level with the longitudinal axis 9 in the normal position of the bush 29 and the locking member could be retracted by optional rotation of the bush in one direction or the other. Orientation of the latch towards one side or the other of a door or the like with this embodiment would merely require turning the entire lock through 180°.

Finally, the guide tracks 23, 23*a* and 131 may form angles other than the illustrated angles of about 45° with the longitudinal axis 9. In any individual case, the particular angle and the length of the guide tracks are to be chosen on the basis of the desired angle of rotation of the bush and shifting distances of the locking member. Furthermore, the described materials and methods of manufacture for the various parts can be released by others. It would be possible, for example, to assemble the entire lock from plastics parts, although for reasons of high stability at least the bush with its lever arms 35 and 36 should consist of a casting or forging and of metal.

The embodiment according to FIGS. 38 and 39, above all, is suitable for use of the lock according to the invention as a bolt-type lock with a vacant/engaged indicator, by the latch 133 in this embodiment being replaced by a bolt and the shank 125 being fixedly connected to the slide 127, on the one hand, and the extension 135 of the guide track 131 and the springs 40, 41 and 129 being omitted, on the other hand. The driving pin 37, which is guided in the guide track 131 in the form of a groove or slot, can then both draw the locking member into the open position and push it into the locking position by rotation of the bush 29 in one direction or the other. A conventional olive-shaped locking knob combined with a vacant/engaged indicator could moreover be provided as a handle for the bush.

We claim:

1. A lock for doors or the like, comprising: a case having a longitudinal axis; a locking member slidably mounted in the case parallel to the longitudinal axis, said locking member having at least one slide coupled thereto, said slide having a guide track inclined with respect to the longitudinal axis; an actuator bush rotatably mounted in the case about an axis of rotation arranged at right angles to the longitudinal axis, said bush having a lever arm projecting away radially with respect to the axis of rotation, said slide and said lever arm being arranged between the bush and the locking member, and said lever arm being provided with a driving pin for cooperation with said guide track; at least one first return spring biasing said bush by first spring forces into a normal rest position in which a portion of said bush rests against a wall of said case; at least one second return spring biasing said locking member by second spring forces into a locking position but rendering possible to slide the locking member against said second spring forces into a retracted open position; and a drive mechanism comprising said slide and said lever arm for converting rotary movements of the bush into sliding movements of the locking member and for at least sliding the locking member out of said locking position into said open position by rotation of said bush in a direction against said first spring forces and by cooperation of said guide track and said driving pin.

2. A lock according to claim 1, wherein said slide has a recess or opening for receiving said driving pin and being defined by edges, one of which is said guide track, said second return spring being supported between said locking member and said case.

3. A lock according to claim 1, wherein said slide has a cross piece and a groove or slot for receiving said driving pin and for defining said guide track, said locking member having a shank projecting from said cross piece for rendering possible relative motion between said locking member and said slide and having a stop for securing said shank against withdrawal from the cross piece, said second return spring being supported between said locking member and said slide.

4. A lock according to claim 1, comprising two slides each arranged on one side of the lever arm and provided with guide tracks arranged parallel to one another.

5. A lock according to claim 3, comprising a U-shaped slide provided with two parallel arms connected by said crosspiece and arranged parallel to the longitudinal axis, and guide tracks formed in said arms and arranged parallel to one another.

6. A lock according to claim 2, wherein said slide and said locking member are coupled to coupling elements which form a form-closed connection with mating contact in the direction of the longitudinal axis, while allowing rotation of said locking member about the longitudinal axis relative to said slide.

7. A lock according to claim 6, wherein said coupling elements comprise at least one collar provided at the locking member and projecting at right angles to the longitudinal axis and at least one groove or recess provided at the slide and at least partially accommodating the collar.

8. A lock according to claim 1, wherein said first return spring is a compression spring supported between a lever arm projecting away radially with respect to the axis of rotation of said bush and said case.

9. A lock according to claim 1, wherein said locking member is mounted in the case to be rotatable about the longitudinal axis.

10. A lock according to claim 3, wherein said locking member has a first extension guided in said case and has a certain length and wherein said guide track has a second extension pointing towards said bush and arranged parallel to the longitudinal axis, said second extension having a length corresponding to that of said first extension.

11. A lock according to claim 1, wherein said locking member is housed at one end of said case and a faceplate is coupled to said end in such a manner that said faceplate is swivellable about a swivel axis located at right angles to the longitudinal axis and at right angles to the axis of rotation.

12. A lock according to claim 11, wherein said case has means for swivelling said faceplate about the swivel axis.

13. A lock according to claim 12, wherein said swivelling means has an adjusting ring of varying thickness rotatably mounted between said faceplate and a fixed part of said case.

14. A lock according to claim 11, comprising a covering cap placeable on top of said faceplate and having an opening for receiving said locking member.

15. A lock according to claim 14, wherein said covering cap has means for fixing said locking member against rotation about the longitudinal axis.

* * * * *